United States Patent [19]

Nakamura et al.

[11] Patent Number: 5,000,668

[45] Date of Patent: Mar. 19, 1991

[54] DISTRIBUTION-TYPE FUEL INJECTION PUMP

[75] Inventors: Hisashi Nakamura; Toshiro Hirakawa; Ken-ichi Kubo, all of Higashimatsuyama, Japan

[73] Assignee: Diesel Kiki Co.k Ltd., Tokyo, Japan

[21] Appl. No.: 336,334

[22] Filed: Apr. 11, 1989

[30] Foreign Application Priority Data

Apr. 27, 1988 [JP] Japan ..... 63-102723
Apr. 27, 1988 [JP] Japan ..... 63-55825[U]

[51] Int. Cl.[5] ..... F02M 39/00

[52] U.S. Cl. ..... 417/492; 417/494; 123/449; 123/509

[58] Field of Search ..... 417/492, 494, 500, 499; 123/449, 503, 506, 495, 509

[56] References Cited

U.S. PATENT DOCUMENTS 4,546,749 10/1985 Igashira et al. ..... 123/506
4,697,565 10/1987 Kobayashi et al. .
4,763,611 8/1988 Kobayashi et al. .
4,793,314 12/1988 Yoshinaga et al. ..... 123/506

FOREIGN PATENT DOCUMENTS 60-147544 8/1985 Japan .
61-14069 7/1986 Japan .
61-140171 8/1986 Japan .
62-88876 6/1987 Japan .
62-165465 10/1987 Japan .
62-243962 10/1987 Japan .
62-258125 11/1987 Japan .
62-258157 11/1987 Japan .

*Primary Examiner*—Leonard E. Smith
*Assistant Examiner*—John A. Savio, III
*Attorney, Agent, or Firm*—Fish & Richardson

[57] ABSTRACT

In a distribution-type fuel injection pump, a fuel supply passageway, through which a feed pump and a fuel pressurizing chamber communicate with each other, is isolated from a cam chamber and bypasses the same. In order to simplify the construction, the fuel supply passageway is formed in a peripheral wall portion of a housing. On the other hand, a cam mechanism comprises a spring assembly including at least one spring, first and second annular spring seats and an engaging member. The first spring seat has an annular base section and an extension extending from a peripheral edge of the base section toward the second spring seat. The engaging member is fixedly mounted to a forward end of the extension. Prior to incorporation the spring assembly into a hollow body of the housing, the spring assembly is in a state in which the peripheral edge of the second spring seat is engaged with the engaging member under elastic force of the spring. After the spring assembly has been incorporated into the body through an opening at one end thereof, bolts are employed to fixedly mount the head to the body against the spring to close the opening of the body.

10 Claims, 3 Drawing Sheets

DISTRIBUTION-TYPE FUEL INJECTION PUMP

BACKGROUND OF THE INVENTION

The present invention relates to a distribution-type fuel injection pump for supplying fuel to a diesel engine or the like.

A distribution-type fuel injection pump is known from, for example, Japanese Patent Provisional Publication Nos. SHO 62-243962, SHO 62-258125 and SHO 62-258157. The known injection pump comprises a housing which is composed of a hollow body whose one end opens, and a head closing the opening of the body. The body and the head cooperate with each other to define an internal space within the housing. A feed pump is arranged at an end of the internal space on the opposite side from the head. The internal space has a major portion thereof which serves as a fuel chamber in which fuel discharged from the feed pump is stored.

A barrel is supported by the head. A drive shaft extends through a portion of the body on the opposite side from the barrel and is supported by the portion of the body in coaxial relation to the barrel. Rotation of an engine is transmitted to the drive shaft to rotate the same. The drive shaft has an inward end which is exposed to the fuel chamber. A plunger has one end thereof which is connected to the inward end of the drive shaft in coaxial relation thereto. Thus, rotational motion of the drive shaft is transmitted to the plunger.

The fuel chamber within the housing serves also as a cam chamber in which a cam mechanism is accomodated. The cam mechanism comprises a roller holder, a plurality of rollers rotatably supported by the roller holder, a cam disc connected to the one end of the plunger in contact with the rollers, and at least one spring biasing the plunger and the cam disc toward the rollers. The cam mechanism gives axial reciprocative movement to the plunger when the same rotates.

The plunger has the other end which is inserted in the barrel for axial reciprocative movement therealong. The barrel and the plunger cooperate with each other to define a fuel pressurizing chamber. The housing is formed therein with a fuel supply passageway, and a plurality of fuel discharge passageways corresponding in number to cylinders of the engine. The fuel supply passageway cooperates with a plurality of passages formed in the plunger to supply fuel within the fuel chamber to the fuel pressurizing chamber at a backward or return stroke of the plunger. The fuel discharge passageways cooperate with another passage formed in the plunger to supply the pressurized fuel within the fuel pressurizing chamber successively to the cylinders of the engine at a forward stroke of the plunger.

The fuel filled in the fuel chamber serves as lubricating oil for the cam mechanism. Accordingly, there is provided a sufficient lubricating effect with respect to the cam mechanism, if light oil that is regular fuel for the diesel engine is used as the fuel. However, if a user, who does not know that the fuel serves also as lubricating oil, employs fuel lighter in quality than the light oil such as, for example, kerosene or lamp oil in substitution for the light oil, lubrication with respect to the cam mechanism becomes insufficient. Thus, a surface layer is separated from each roller and the cam disc which are in contact with each other under the strong resilient or elastic force of the spring. The separated surface layers impede motion of the component parts within the housing.

Japanese Patent Provisional Publication No. SHO 60-147544, Japanese Utility Model Provisional Publication No. SHO 61-140171 (corres. to United States Ser. No. 06/824,963) and Japanese Utility Model Provisional Publication No. SHO 61-114069 (corres. to U.S. Pat. No. 4,697,565) disclose an arrangement in which a major portion of the internal space is used only as a cam chamber, and lubricating oil is received in the cam chamber. A fuel supply passageway bypasses the cam chamber, and the feed pump communicates with the fuel pressurizing chamber through the fuel supply passageway. With such arrangement, the cam mechanism can be well lubricated by the lubricating oil regardless of the type of the fuel. However, the arrangement is disadvantageous in that, since the fuel supply passageway utilizes a pipe connected to the housing, the pump is complicated in construction.

Additionally, Japanese Utility Model Provisional Publication No. SHO 62-88876 (corres. to U.S. Pat. No. 4,763,611) and Japanese Utility Model Provisional Publication No. SHO 62-165465 disclose a technique relevant to the invention. In pumps disclosed in these publications, however, a major portion of the internal space within the housing is utilized as a fuel chamber, and a cam mechanism is arranged within the fuel chamber.

On the other hand, the previously mentioned pump has the following additional problem. Specifically, component parts of the cam mechanism are accommodated into the body through the opening thereof. At this time, the spring is accommodated in the body under such a condition that the spring has its natural length. Subsequently, the spring is compressed by the head when the head is fixedly mounted to the body. Since high precision is required for operation of assembling various component parts into the pump, the operation normally relies upon human hands or power. For this reason, there is a limit in the force for retaining and holding the spring so that it is difficult to sufficiently strengthen the elastic force of the spring. Thus, jumping of the plunger cannot sufficiently be restrained during running. Further, in order to fixedly mount the head to the body, it is required that bolts extending through the head are screwed into the body while urging the head against the body against the biasing force of the spring. Thus, working or operating efficiency is low. Furthermore, when the spring is accommodated into the body, it is required that the position and posture of the spring are corrected through an opening formed in the peripheral wall of the body. Also in this respect, the working or operating efficiency is low.

SUMMARY OF THE INVENTION

It is an object of the invention to provide a distribution-type fuel injection pump in which lubrication of a cam mechanism can always be effected satisfactorily regardless of the type of fuel and which is simple in construction.

It is another object of the invention to provide a distribution-type fuel injection pump and a manufacturing method thereof, in which spring means for a cam mechanism can be strengthened in elastic force, and in which it is possible to facilitate operation of incorporation of the spring means and a head of a housing into a body thereof.

According to the invention, there is provided a distribution-type fuel injection pump comprising:

(a) a housing having an internal space and a barrel section, the internal space having a small chamber and a large chamber which are isolated from each other, the large chamber including a cam chamber in which lubricating oil is accumulated;

(b) a drive shaft extending through and supported by a portion of the housing on the opposite side from the barrel section, the drive shaft having one end thereof projecting to the outside of the housing, the other end of the drive shaft being exposed to the cam chamber;

(c) a plunger having one end thereof connected to the other end of the drive shaft in such a manner that rotation of the drive shaft can be transmitted to the plunger and that the plunger can axially reciprocate relatively to the drive shaft, the other end of the plunger being inserted in the barrel section and cooperating with the latter to define a fuel pressurizing chamber;

(d) a cam mechanism accommodated in the cam chamber for giving axial reciprocative motion to the plunger following rotation of the latter;

(e) a feed pump arranged within the small chamber in the housing and driven by the drive shaft to feed fuel;

(f) a fuel supply passageway provided in the housing, the fuel supply passageway being cut off from communication with the cam chamber and bypassing the latter such that the feed pump communicates with the fuel pressurizing chamber through the fuel supply passageway; and (g) a plurality of fuel discharge passageways provided in the housing, wherein pressurized fuel within the fuel pressurizing chamber is supplied successively to the fuel discharge passageways, wherein the fuel supply passageway is formed in a peripheral wall portion of the housing which surrounds the cam chamber.

According to the invention, there is further provided a diatribution-type fuel injection pump comprising:

(a) a housing having a hollow body whose one end opens, a head fixedly mounted to the body by means of bolts so as to close the opening of the body, and a barrel section provided at the head;

(b) a drive shaft extending through and supported by a portion of the body on the opposite side from the barrel section, the drive shaft having one end thereof which projects to the outside of the body, the other end of the drive shaft being exposed to the hollow portion of the body;

(c) a plunger having one end thereof connected to the other end of the drive shaft in such a manner that rotation of the drive shaft can be transmitted to the plunger and that the plunger can axially reciprocate relatively to the drive shaft, the other end of the plunger being inserted in the barrel section and cooperating with the barrel section to define a fuel pressurizing chamber; and (d) a cam mechanism accommodated in the housing for giving axial reciprocative motion to the plunger following rotation of the plunger, the cam mechanism comprising a roller holder, a plurality of rollers rotatably supported by the roller holder, a cam disc connected to the plunger and in contact with the rollers, and a spring assembly biasing the plunger and the cam disc toward the rollers, wherein the spring assembly comprises spring means, a pair of first and second annular spring seats and an engaging member, wherein the plunger extends through the first and second spring seats, and the first and second spring seats are arranged respectively at opposite ends of the spring means, wherein the first spring seat has an annular base section and an extension extending from a peripheral edge of the base section toward the second spring seat, the engaging member being fixedly mounted to a forward end of the extension, wherein the second spring seat has a peripheral edge which is arranged within the extension of the first spring seat, wherein the engaging member projects radially inwardly from the forward end of the extension of the first spring seat, wherein the peripheral edge of the second spring seat is located at a position spaced from the engaging member toward the base section of the first spring seat, and wherein the second spring seat is urged toward the cam disc by the spring means.

According to the invention, there is still further provided a method of manufacturing a distribution-type fuel injection pump, comprising the steps of:

(a) in a state in which a pair of first and second spring seats are arranged respectively at opposite ends of spring means, moving at least one of the first and second spring seats toward the other while compressing the spring means, wherein the first spring seat is provided with a base section and an extension extending from a peripheral edge of the base section toward the second spring seat, and wherein, by compression of the spring means, a peripheral edge of the second spring seat is located at a position spaced from a forward end of the extension of the first spring seat toward the base section;

(b) in a state in which the spring means is compressed, fixedly mounting an engaging member to the forward end of the extension of the first spring seat;

(c) after fixed mounting of the engaging member, releasing the compressed state of the spring means, to bring the peripheral edge of the second spring seat into engagement with the engaging member under elastic force of the spring means, thereby assembling a spring assembly;

(d) accommodating the spring assembly into a hollow body whose one end opens, wherein the second spring seat is received by a cam disc which has already been accommodated in the body before the spring assembly; and (e) fixedly mounting a head to the body to close the opening of the body, wherein bolts extending through the head are screwed into the body whereby the head is fixedly mounted to the head, wherein, at the screwing of the bolts, the bolts receive the elastic force of the spring means for the first time when the bolts are screwed into the body by their respective predetermined amounts, wherein, after the bolts have been screwed into the body by their respective predetermined amounts, the bolts are further screwed into the body against the elastic force of the spring means, whereby the head is fixedly mounted to the body, and wherein, at the fixed mounting of the head to the body, the engaging member moves toward the cam disc relatively to the second spring seat, whereby the second spring seat is separated from the engaging member so that the second spring seat is located at a position spaced from the engaging member toward the head.

DETAILED DESCRIPTION

Figure 1:
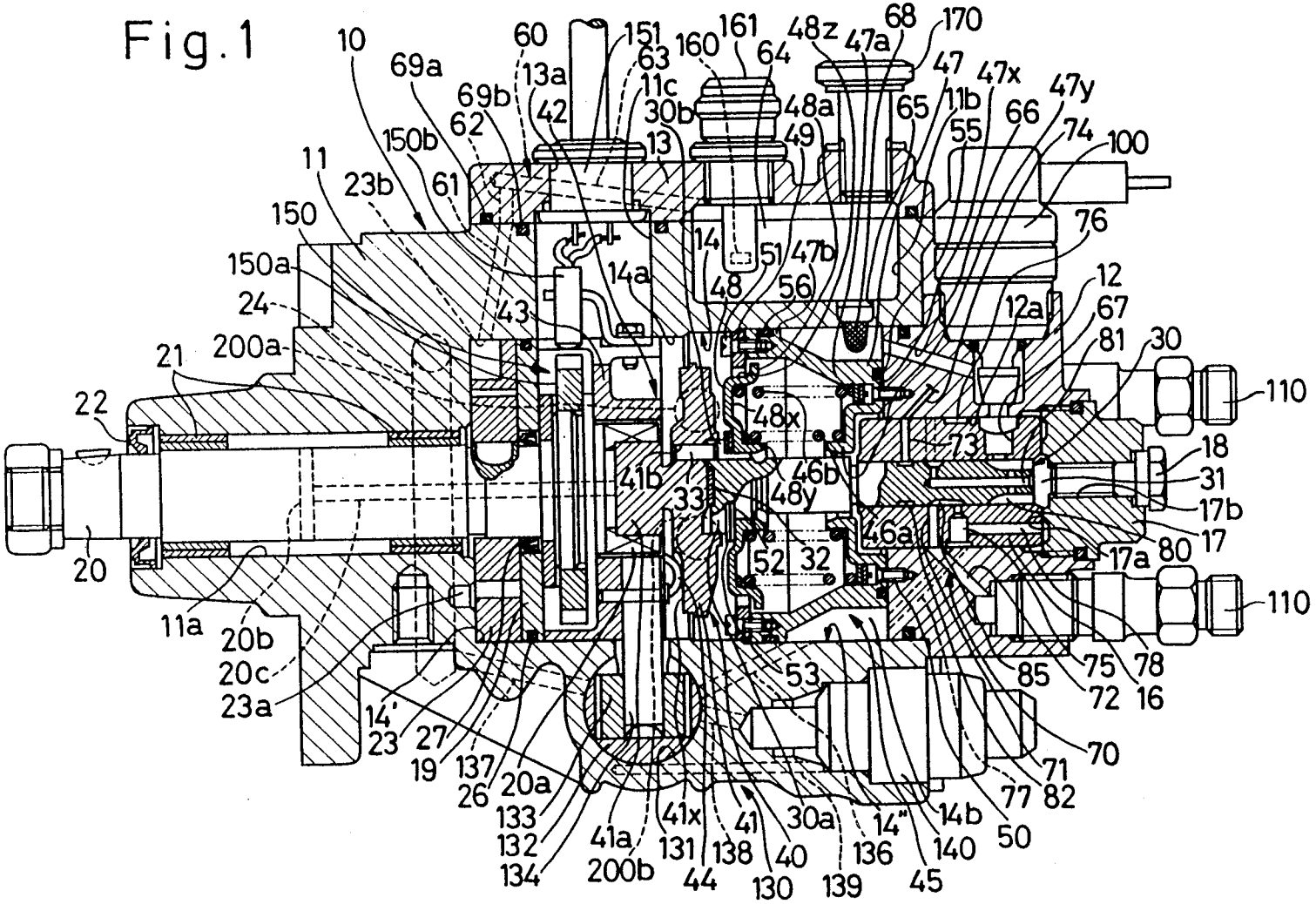
FIG. 1 is a longitudinal cross-sectional view of the entire distribution-type fuel injection pump controlled by an electromagnetic valve, according to an embodiment of the invention.
Figure 2:
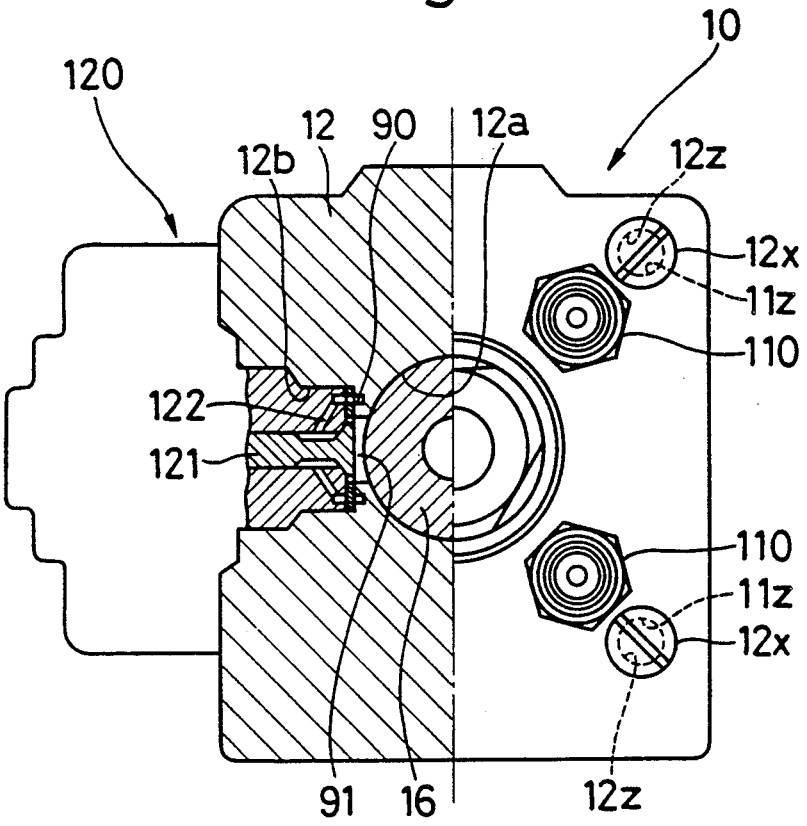
FIG. 2 is a view of the electromagnetic valve mounted to a head illustrated in FIG. 1, with a right-hand half portion shown in side elevation, and with a left-hand half portion shown in cross-section.

Referring to the drawings, particularly, to FIG. 1, there is shown a distribution-type fuel injection pump according to an embodiment of the invention. The fuel injection pump comprises a housing 10 whose primary component parts include a hollow body 11 having one end (right-hand end in FIG. 1) thereof which opens, a head 12 by which the opening of the body 11 is closed, and a cover 13 fixedly mounted to the top of the body 11. As shown in FIG. 2, a plurality of bolts 12*x* extending through the head 12 are screwed into an end face of the body 11 so that the head 12 is fixedly mounted to the body 11.

Referring back to FIG. 1, the head 12 is formed therein with a bore 12*a* in which fixedly inserted is a barrel (barrel section ) 16 which serves a part of the housing 10. A head plug 17 is also screwed into the bore 12*a* in the head 12. The head plug 17 has an end face formed with an annular ridge 17*a* which is strongly in contact with an end face of the barrel 16 to provide oil-tightness therebetween. A threaded bore 17*b* extends through the center of the head plug 17, and a bolt 18 is screwed into the threaded bore 17*b*.

The housing 10 has an internal space 14 of circular cross-section which is defined by the body 11, the head 12, the cover 13 and the barrel 16. The internal space 14 is divided into a small chamber 14' and a large chamber 14'' by a shielding or partition plate 19. The large chamber 14'' has its major portion which serves as a cam chamber 14*a*.

A bore 11*a* is formed in an end (left-hand end as viewed in FIG. 1) of the body 11. A drive shaft 20 extends through the bore 11*a*, and is rotatably supported by a pair of bearings 21 and 21. The drive shaft 20 extends in coaxial relation to the barrel 16. The drive shaft 20 has its left-hand outward end which is connected to a crankshaft of an engine through a reducing gear train and so on (not shown). Thus, rotation of the crankshaft is transmitted to the drive shaft 20. A seal ring 22 is interposed between the drive shaft 20 and an inner peripheral surface of the outward end of the bore 11*a* in the body 11, to isolate the bearings 21 and 21 from the outside in an oil-tight fashion. The drive shaft 20 extends through the partition plate 19 and has a right-hand inward end which extends to the cam chamber 14*a*. An O-ring 26 and a seal ring 27 are interposed respectively between an outer peripheral surface of the partition plate 29 and an inner peripheral surface of the body 11 and between an inner peripheral surface of the partition plate 19 and the outer peripheral surface of the drive shaft 20. By these seal elements 26 and 27, the small chamber 14' is isolated from the cam chamber 14*a* in an oil-tight manner.

The drive shaft 20 is formed therein with a lateral bore 20*b* whose opposite ends open to the outer peripheral surface of the drive shaft 20 at a location between the pair of bearings 21 and 21. The drive shaft 20 is formed therein also with an axial bore 20*c* whose one end communicates with the lateral bore 20*b*. The other end of the axial bore 20*c* opens to the right-hand end face of the drive shaft 20.

Accommodated in the small chamber 14' within the housing 10 is a feed pump 23 which is driven by the drive shaft 20. The feed pump 23 has a suction port 23*a* which is formed in a left-hand end face of the small chamber 14'. The suction port 23*a* communicates with a fuel tank (not shown) through a suction passage 24 formed in the body 11 and a pipe (not shown). The feed pump 23 has a discharge port 23*b* which is formed in the peripheral surface of the small chamber 14' and which communicates with a fuel supply passageway 60 to be described later.

A plunger 30 has a left-hand end which is connected to the inward end of the drive shaft 20 in coaxial relation thereto. Specifically, the plunger 30 is formed at its left-hand end with a large-diameter section 30*a* which is in contact with a cam disc 41 of a cam mechanism 40 to be described later, through one or more shims 32 for regulation of a stroke of the plunger 30. A pin 33 is inserted in a bore 41*b* formed in the cam disc 41. The pin 33 is fitted in a cut-out 30*b* formed in the large-diameter section 30*a* of the plunger 30. By the pin 33, the cam disc 41 and the plunger 30 are connected to each other such that rotation of the cam disc 41 can be transmitted to the plunger 30. The cam disc 41 is formed at its left-hand end with a coupler section 41*a* having a non-circular cross-section. The coupler section 41*a* is in mesh with projections 20*a* formed at the right-hand end of the drive shaft 20. By the meshing engagement, the cam disc 41 and the plunger 30 are connected to the drive shaft 20 such that rotation of the drive shaft 20 can be transmitted to the cam disc 41 and the plunger 30 and that the cam disc 41 and the plunger 30 can axially reciprocate relatively to the drive shaft 20.

The plunger 30 is given reciprocative motion by the cam mechanism 40 when the plunger 30 rotates. The cam mechanism 40 is accommodated in the cam chamber 14*a*, and comprises the aforementioned cam disc 41, a roller assembly 42 and a spring assembly 45. The roller assembly 42 is composed of a roller holder 43 in the form of a ring which is located adjacent the partition plate 19 and which is rotatably inserted in the cam chamber 14*a*, and a plurality of rollers 44 (only one shown in FIG. 1, but all shown in FIG. 4) supported rotatably by the roller holder 43. The cam disc 41 is formed at its lend-hand end face serving as a cam face 41*x* which is in contact with the rollers 44. When the cam disc 41 rotates relatively to the rollers 44 following rotation of the plunger 30, the cam disc 41 reciprocates axially. Following the axial reciprocative movement of the cam disc 41, the plunger 30 reciprocates.

The aforementioned spring assembly 45 serves to bias the cam disc 41 toward the rollers 44, and is composed of a pair of first and second annular spring retainers or seats 47 and 48, a pair of compression springs 46*a* and 46*b* arranged between the spring seats 47 and 48 in concentric relation to each other, and a stopper or engaging ring 49 fixedly mounted to the first spring seat 47.

Figure 5:
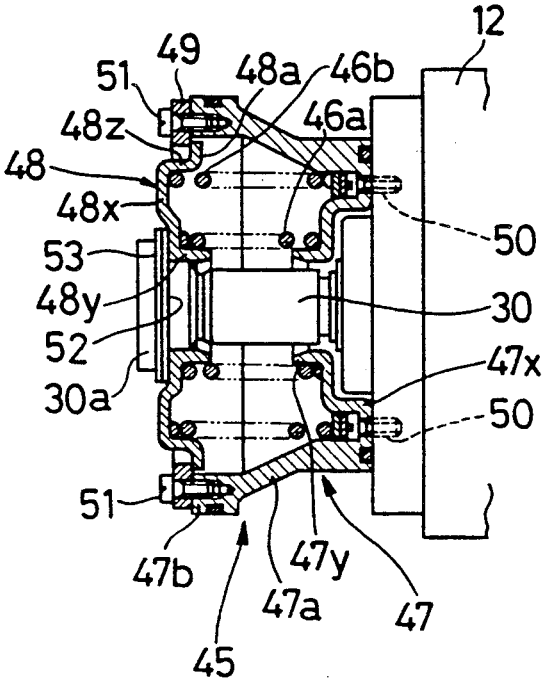
FIG. 5 is a fragmentary cross-sectional view of the spring assembly which is mounted to the head of the housing, with the spring assembly shown in a state prior to being inserted into the body.

As shown also in FIG. 5, the first spring seat 47 has a base section 47*x* provided with an annular step. The base section 47x is fixed to the head 12 by means of screws 50 in a state in which the base section 47x is in contact with an inward end face of the head 12. A tubular section 47y extends from an inner peripheral edge of the base section 47x toward the second spring seat 48. Further, another tubular section 47a is formed on an outer peripheral edge of the base section 47x. The tubular section 47a has a first portion extending parallel to the plunger 30 toward the second spring seat 48, and a second portion extending such that a diameter of the second portion increases gradually toward the second spring seat 48. The tubular section 47a has a forward end 47b whose peripheral surface is cylindrical in shape. The cylindrical peripheral surface of the forward end 47b is in contact with the inner peripheral surface of the internal space 14. Thus, the large chamber 14" of the internal space 14 is divided into the cam chamber 14a and an annular space 14b isolated from the cam chamber 14a by means of a pair of O-rings 55 and 56 in an oil-tight manner.

The second spring seat 48 has a base section 48x, a pair of tubular sections 48y and 48z formed respectively at inner and outer peripheral edges of the base section 48x and extending toward the first spring seat 47, and a peripheral edge 48a extending radially outwardly from the radially outward tubular section 48z.

The spring 46a has its opposite ends which are supported respectively by the tubular sections 47y and 48y of the spring seats 47 and 48. The spring 46b has its opposite ends which are supported respectively by the tubular sections 47a and 48z of the spring seats 47 and 48.

The forward end 47b of the first spring seat 47 has a left-hand end face to which the engaging ring 49 is fixedly mounted by means of screws 51. The second spring seat 48 has its outer diameter which is smaller than an inner diameter of the forward end 47b of the first spring seat 47, but which is larger than an inner diameter of the engaging ring 49. The engaging ring 49 plays its role only when the spring assembly 45 is assembled as shown in FIG. 5 to be described later, but bears any no role after the spring assembly 45 has been incorporated in the housing 10 as shown in FIG. 1. The peripheral edge 48a of the second spring seat 48 is spaced away from the engaging ring 49 toward the head 12.

The left-hand end face of the second spring seat 48 is engaged with the large-diameter section 30a formed at the left-hand end of the plunger 30, through a bearing washer 52 and one or more shims 53 for regulation of the biasing force of the spring assembly 45. By the second spring seat 48, the biasing or elastic force of the springs 46a and 46b is transmitted to the plunger 30 and the cam disc 41.

The right-hand end of the plunger 30 is inserted in the barrel 16. A fuel pressurizing chamber 31 is defined by the plunger 30, the head plug 17 and the barrel 16. The fuel pressurizing chamber 31 communicates with the aforementioned discharge port 23b of the feed pump 23 through the fuel supply passageway 60 formed in the housing 10.

The fuel supply passageway 60 will be described below in detail. A passage 61 is formed in the peripheral wall of the body 11 surrounding the internal space 14 and extends radially through the peripheral wall of the body 11. The passage 61 has its one end which serves as the discharge port 23b of the feed pump 23. The other end of the passage 61 opens to the outer surface of the peripheral wall of the body 11. The cover 13 is formed therein with a passage 62 which extends radially of the body 11. The passage 62 has one end thereof which opens to the lower surface of the cover 13 and which communicates with the other end of the passage 61 in the body 11. The cover 13 is formed therein also with a passage 63 which extends substantially axially of the body 11. The passage 63 has one end thereof communicating with the other end of the passage 62. The other end of the passage 63 opens to the lower surface of the cover 13. The body 11 is formed at its top with a recess 11b which is covered by the cover 13. The recess 11b cooperates with the cover 13 to define a fuel reservoir chamber 64. The fuel reservoir chamber 64 communicates, on one hand, with the other end of the passage 63 and, on the other hand, with the annular space 14b through a bore 65 formed in the bottom wall of the recess 11b. The head 12 is formed therein with a passage 66 whose one end opens to the inward end face of the head 12 and which communicates with the annular space 14b. The other end of the passage 66 opens to the inner peripheral surface of the bore 12a in the head 12. The barrel 16 is formed therein with a passage 67 which extends radially through the wall of the barrel 16. The passage 67 has one end thereof communicating with the other end of the passage 66. The other end of the passage 67 opens to the inner peripheral surface of the barrel 16.

A filter 68 is mounted to the bore 65 which forms a part of the fuel supply passageway 60. Further, arranged at the passage 66 is a normally-closed electromagnetic valve 100 which is operative in response to turning-on of an ignition key to open the passage 66 only during running of the engine.

The passages 61, 62 and 63 of the fuel supply passageway 60 and the fuel reservoir chamber 64 are isolated in an oil-tight manner from the outside and from the cam chamber 14a by a pair of O-rings 69a and 69b arranged between the body 11 and the cover 13.

Mounted to the head 12 of the housing 10 are a plurality of delivery valves 110 corresponding in number to the engine cylinders. The delivery valves 110 communicate respectively with injection nozzles mounted to the engine cylinders, through pipes (not shown).

The housing 10 has a plurality of fuel discharge passageways 70 through which the fuel pressurizing chamber 31 can communicate with the plurality of delivery valves 110. Each of the fuel discharge passageways 70 will be described below in detail. The barrel 16 has a radially extending passage 71 whose one end opens to the inner peripheral surface of the barrel 16. The other end of the passage 71 opens to the outer peripheral surface of the barrel 16. The head 12 has a passage 72 through which the other end of the passage 71 communicates with the delivery valve 110.

The plunger 30 has a plurality of suction ports 80 formed at the peripheral surface of the end of the plunger 30. The suction ports 80 are formed respectively by longitudinal grooves corresponding in number to the engine cylinders. When the plunger 30 reaches a predetermined rotational angle position at the return stroke of the plunger 30 in the left-hand direction as viewed in FIG. 1, the fuel pressurizing chamber 31 communicates with the fuel supply passageway 60 through one of the plurality of suction ports 80. Thus, the fuel from the feed pump 23 is supplied to the fuel pressurizing chamber 31.

The plunger 30 further has a discharge passage 81 formed by a generally L-shaped bore. The discharge passage 81 has one end thereof which opens to the end face of the plunger 30. The other end of the discharge passage 81 opens to the peripheral surface of the plunger 30. When the plunger 30 reaches a predetermined rotational angle position at the forward stroke of the plunger 30 in the right-hand direction as viewed in FIG. 1, one of the plurality of fuel discharge passageways 70 communicates with the fuel pressurizing chamber 31 through the discharge passage 81. Thus, the fuel within the fuel pressurizing chamber 31 can be discharged to the fuel discharge passageway 70.

As shown in FIG. 2, an electromagnetic valve 120 for controlling escape of the pressurized fuel is arranged at the lateral side of the head 12 of the housing 10. That is, one end of the electromagnetic valve 120 is fixedly inserted in a recess **12*b* formed in the head 12. An annular groove 90 is formed in the bottom surface of the recess 12*b*. The annular groove 90 communicates with the fuel pressurizing chamber 31 through passages (not shown) which are formed respectively in the head 12 and a portion of the barrel 16 adjacent the right-hand end thereof as viewed in FIG. 1. Further, formed at the center of the bottom surface of the recess 12*b* is a spill chamber 91 which is closed by the barrel 16. The spill chamber 91 communicates with the passage 66 of the fuel supply passageway 60 or the annular space 14*b*, through another passage (not shown) formed in the head 12. In this connection, the spill chamber 91 may communicate with the fuel tank through a passage (not shown) formed in the head 12 and through a pipe (not shown). The annular groove 90, the spill chamber 91** and the above-described not-shown passages cooperate with each other to define a fuel escape passageway.

At the forward stroke of the plunger 30, a poppet valve element 121 of the electromagnetic valve 120 closes an internal passage 122 formed in the electromagnetic valve 120 to isolate communication between the fuel pressurizing chamber 31 and the fuel supply passageway 60. When the communication between the fuel pressurizing chamber 31 and the fuel supply passageway 60 is cut off, the fuel is brought to a high-pressure level so that the fuel is injected from each of the nozzles at the engine through a corresponding one of the fuel discharge passageways 70 and through a corresponding one of the delivery valves 120. On the other hand, when the electromagnetic valve 120 is opened at the forward stroke of the plunger 30, the the pressurizing fuel within the fuel pressurizing chamber 31 escapes to the fuel supply passageway 60, so that the fuel injection is terminated. In this manner, control of escape of the fuel by means of the electromagnetic valve 120 controls the fuel-injection starting and/or terminating timing.

Referring back to FIG. 1, an annular leak-stopper groove 82 is formed in the peripheral surface of the plunger 30. When the fuel within the fuel pressurizing chamber 31 is pressurized to a high level, a slight amount of fuel tends to escape toward the cam chamber **14*a* of the atmospheric pressure, through a slight gap between the plunger 30 and the barrel 16. However, the slight amount of fuel is received by the leak-stopper groove 82, and is returned to the fuel supply passageway 60 or to the fuel tank through leak passages 73 and 74 formed respectively in the barrel 16 and the head 12** and, if necessary, through a pipe (not shown).

Moreover, formed in the peripheral surface of the plunger 30 are a plurality of axially extending pressure-balancing slits 85 corresponding in number to the engine cylinders. On the other hand, the barrel 16 has a pressure-balancing port 75 extending radially, and an annular groove 76 formed in the outer peripheral surface of the barrel 16. The head 12 is formed therein with a pressure-balancing passage 77 through which the annular groove 76 communicates with the annular space **14*b*. When the plunger 30 is in a predetermined stroke position and in a predetermined rotational angle position after injection of the fuel, one of the pressure-balancing slits 85 registers with the pressure-balancing port 75 and the passage 71, so that the corresponding fuel discharge passageway 70 communicates with the annular space 14*b*. Thus, the residual pressure within the fuel discharge passageway 70** is made equal to the fuel supply pressure, thereby securing subsequent stable fuel injection.

In connection with the above, the pressure-balancing balancing port 75 of the barrel 16 communicates with the leak passage 78 which opens to the end face of the barrel 16. Leak fuel passing through a gap between the end face of the barrel 16 and the annular projection **17*a* of the head plug 17 is returned to the annular space 14*b* through the leak passage 78, the pressure-balancing port 75, the annular groove 76 and the pressure-balancing passage 77**.

Figure 4:
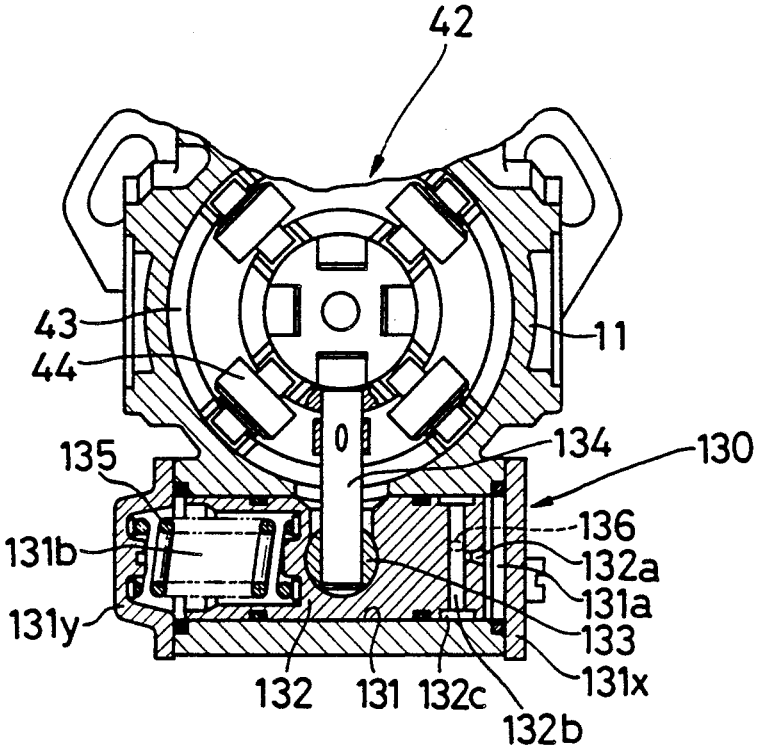
FIG. 4 is a fragmentary cross-sectional view of the fuel injection pump illustrated in FIG. 1, in a plane perpendicular to the drawing sheet of FIG. 1, in order to show a roller assembly and a timer device.

A timer device 130 is arranged at the lower portion of the housing 10. As shown in FIG. 4, the timer device 130 has a cylinder section 131 formed in the lower portion of the body 11. The cylinder section 131 has its opposite ends which are closed respectively by closure plates **131*x* and 131*y*. A piston 132 is accommodated in the cylinder 131 for sliding movement therealong. By the piston 132, the cylinder section 131 is divided into a pair of chambers 131*a* and 131*b*. A block 133 is rotatably fitted in the center of the piston 132. The block 133 is connected to the aforesaid roller holder 43 through a link 134. A spring 135 is accommodated in the chamber 131*b* and biases the piston 132 toward the chamber 131*a*. The chamber 131*a* communicates with he annular space 14*b* through an orifice 132*a*, a radially extending bore 132*b* and an annular groove 132*c* formed in the piston 132, and a passage 136 (see also FIG. 1) formed in the body 11. The chamber 131*b* communicates with the suction passage 24 of the feed pump 23 through a passage 137 shown in FIG. 1. Further, the chambers 131*a* and 131*b* communicate with each other through pressure passages 138 and 139 shown in FIG. 1. An electromagnetic valve 140 is arranged between the passages 138 and 139**.

The electromagnetic valve 140 is supplied with electric current duty-controlled, to regulate a flow-passage area for the fuel, thereby adjusting pressure within the chamber **131*a*. The roller holder 43 is adjusted in its angular movement in such a manner that the roller holder 43 is brought to a position where the pressure within the chamber 131*a* is balanced with the biasing force of the spring 135. This controls a region used of the cam profile of the cam disc 41** during the aforesaid fuel injection period, to obtain a fuel delivery rate corresponding to the running condition.

A rotation detecting device 150 is accommodated in the left-hand end of the cam chamber **14*a* within the housing 10. The rotation detecting device 150 comprises a toothed rotor 150*a* fixedly mounted to the drive shaft 20, and an electromagnetic pick-up 150*b* which is supported by the roller holder 43 and which is accommodated in a bore 11*c* formed in the upper wall of the body 11. The electromagnetic pick-up 150***b* is electrically connected to a terminal element 151 which is inserted in and supported by a bore 13*a* formed in the cover 13.

Screwed into the cover 13 is a bolt 161 in which a fuel-temperature sensor 160 is incorporated. Temperature of the fuel within the fuel reservoir chamber 64 is detected by the fuel-temperature sensor 160. Screwed into the cover 13 in facing relation to the fuel reservoir chamber 64 is an eyebolt 170 provided therein with an overflow orifice for proportioning the fuel supply pressure to the rotational speed of the feed pump 23.

Figure 3:
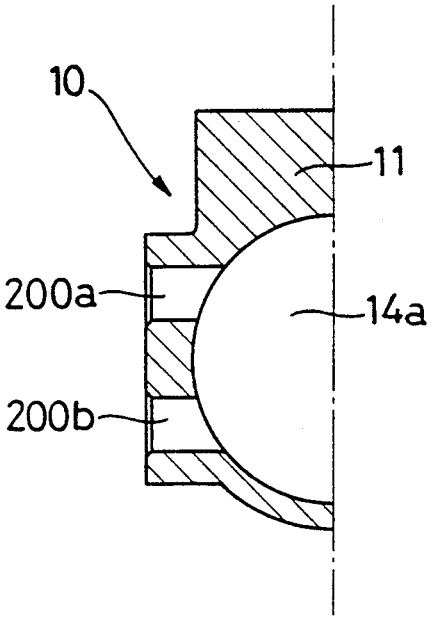
FIG. 3 is a cross-sectional view of a housing in a plane perpendicular to the drawing sheet of FIG. 1, in order to show an inlet port and an outlet port for lubricating oil.

As shown also in FIG. 3, the body 11 of the housing 10 is formed therein with an inlet port 200*a* and an outlet port 200*b* which open to the cam chamber 14*a*. Eyebolts (not shown) are screwed respectively into the ports 200*a* and 200*b*. The cam chamber 14*a* communicates with a recirculating system for engine oil through the eyebolts. In the recirculating system, the engine oil from an oil tank is recirculated through the engine by an oil pump and is returned to the oil tank through the cam chamber 14*a*. Accordingly, the lubricating oil consisting of the engine oil is always stored at the bottom of the cam chamber 14*a*.

With the arrangement described above, the lubricating oil accumulated in the cam chamber 14*a* is scooped up by the cam disc 41 rotating at high speed, and is scattered, so that the lubricating oil is supplied to the cam face 41*x* of the cam disc 41 and to the rollers 44, thereby effecting lubrication between the cam face 41 and the rollers 44. At this time, the fuel discharged from the feed pump 23 is supplied to the fuel pressurizing chamber 31 through the fuel supply passageway 60, but is not supplied to the cam chamber 14*a* so that the fuel does not bear such a role or function as to lubricate the cam mechanism 40. Thus, even if a user inadvertently uses kerosene or lamp oil or the like as the fuel, the cam mechanism 40 can always be lubricated by oil suitable for lubrication regardless of the inadvertent use, making it possible to prevent a surface layer from being separated from the cam disc 41 and from each roller 44.

In connection with the above, the lubricating oil scattered in the manner as described above is supplied also to the plunger 30, to effect lubrication between the plunger 30 and the barrel 16. Further, the scattered lubricating oil is supplied also to the pair of bearings 21 and 21 through the axial bore 20*c* and the lateral bore 20*b* formed in the drive shaft 20, to lubricate the pair of bearings 21 and 21.

As described previously, spill control of the fuel is carried out by the electromagnetic valve 120 in such a manner that the spill fuel is returned to the fuel supply passageway 60 or to the fuel tank, but is not returned to the cam chamber 14*a*. Thus, the spill fuel is prevented from being mixed with the lubricating oil. Further, the feed pump 23 and the fuel supply passageway 60 are isolated from the cam chamber 14*a* by seal means in an oil-tight manner, so that the fuel does not flow into the cam chamber 14*a*. Therefore, the lubricating oil is prevented from being diluted by the fuel, making it possible to secure excellent lubrication with respect to the cam mechanism 40. Furthermore, since the fuel flowing from the fuel pressurizing chamber 31 through the slight gap between the plunger 30 and the barrel 16 is collected by the leak stopper groove 82, it is possible to prevent leakage of the fuel to the cam chamber 14*a*.

The fuel from the feed pump 23 is once stored in the fuel reservoir chamber 64. Since, however, pulsation of the fuel pressure can be absorbed by the fuel reservoir chamber 64, it is possible to supply the fuel in a stable manner. Further, since the fuel-temperature sensor 160 is arranged within the fuel reservoir chamber 64, it is possible to accurately measure the fuel temperature.

The fuel supply passageway 60 bypasses the cam chamber 14*a*. Since, however, a part of the fuel supply passageway 60 is formed in the cover 13 which closes the cam chamber 14*a*, it is possible to avoid an increase in size of the pump so that the pump can be brought to its size substantially equal to the conventional pump. Furthermore, since the use of a pipe for the fuel supply passageway 60 is dispensed with, the construction can extremely be simplified.

Moreover, in the fuel supply passageway 60, the annular space 14*b*, through which the fuel reservoir chamber 64 communicates with the passage 66 in the head 12, is formed by a part of the internal space 14 within the body 11. This also makes it possible to avoid an increase in size of the pump. In addition, the annular space 14 introduces the pressure of the fuel within the fuel reservoir chamber 64 formed in the upper portion of the housing, into the timer device 130 arranged at the lower portion of the housing 10. Accordingly, in order to introduce the pressure into the timer device 130, it is dispensed with to form bores in the body 11 and to use pipes, making it possible to simplify the construction.

Assembling of the fuel injection pump constructed as above will next be described in detail. The spring assembly 45 is assembled in a manner as shown in FIG. 5. That is, the first spring seat 47 is fixedly mounted to the end face of the head 12 by means of the screws 50. The second spring seat 48 is so arranged as to face toward the first spring seat 47. In a state in which the springs 46*a* and 46*b* are arranged between the spring seats 47 and 48, a jig (not shown) is employed to urge the second spring seat 48 toward the first spring seat 47. Thus, the springs 46*a* and 46*b* are compressed, and the peripheral edge 48*a* of the second spring seat 48 is located at a position spaced from the forward end 47*b* of the first spring seat 47 toward the head 12. In this state, the engaging ring 49 is fixedly mounted to the end face of the forward end 47*b* by means of the screws 51. Subsequently, urging by the jig is released. This causes the peripheral edge 48*a* of the second spring seat 48 to be abutted against the engaging ring 49 under the biasing force of the springs 46*a* and 46*b*. The spring assembly 45 is assembled in the manner described above. In this connection, the use of the jig enables the spring assembly 45 to be compressed under strong force. This compressed state can be maintained by abutment of the second spring seat 48 against the engaging ring 49.

The barrel 16 is inserted into and fixed to the bore 12*a* in the head 12 to which the spring assembly 45 is mounted in the manner described above. Further, the plunger 30 is inserted into the barrel 16, and the head plug 17 is inserted into and fixed to the bore 12*a*. In this connection, the bearing washer 52 and the shims 53 are interposed between the large-diameter section 30*a* of the plunger 30 and the second spring seat 48. In this manner, a head assembly is assembled.

On the other hand, the body 11 is set upright with its opening facing upwardly, and the drive shaft 20 is fitted into the body 11. Subsequently, the feed pump 23, the partition plate 19, the rotation detecting device 150, the roller assembly 42 and the cam disc 41 are accommodated into the body 11 and at the bottom of the internal space therein in order mentioned above. Then, the aforesaid head assembly is accommodated into the head 11. At this time, since the springs 46*a* and 46*b* are in the compressed state, it is possible to accommodate the head assembly deep into the body 11. In this state, the bolts 12*x* are inserted respectively into bores 12*z* formed in the head 12 and are screwed respectively into threaded bores 11*z* formed in the body 11. Thus, the head 12 is fixedly mounted to the body 11.

In the step of screwing the bolts 12*x* into the threaded bores 11*z* in the body 11, the bolts 12*x* receive the elastic force of the springs 46*a* and 46*b* for the first time when the bolts 12*x* are screwed into the threaded bores 11*z* by their respective predetermined amounts so that the bolts 12*x* are retained in the bores 11*z*. In other words, the bolts 12*x* do not receive the elastic force of the springs 46*a* and 46*b* until the bolts 12*x* are screwed into the threaded bores 11*z* by their respective predetermined amounts. Accordingly, even if the springs 46*a* and 46*b* are strong in elastic force, it is possible to continue the screwing operation of the bolts 12*x* against the elastic force of the springs 46*a* and 46*b* without any difficulty. When the shoulder of the head 12 is abutted against the end face of the body 11 as shown in FIG. 1, the screwing operation of the bolts 12*x* is terminated.

By the screwing of the bolts 12*x*, the springs 46*a* and 46*b* are compressed more than the state at the time the spring assembly 45 is assembled. Accordingly, the engaging ring 49 is separated from the second spring seat 48. As a result, the elastic force of the springs 46*a* and 46*b* acts upon the plunger 30 and the cam disc 41. Since, as described above, the set force of the springs 46*a* and 46*b* can be strengthened, it is possible to prevent jumping of the cam disc 41 and the plunger 30.

In connection with the above, when the head assembly is incorporated into the head 11, a contact position of the cam disc 41 with the rollers 44 is selected to locate the cam disc 41 at a position nearest to the feed pump 23. In other words, in a state in which the body 11 is set upright, the cam disc 41 is located at the lowest position. In this state, the head assembly is accommodated into the head 11 to fix the same by the bolts 12*x*. By doing so, the amount of screwing of the bolts 12*x* can be minimized.

Since the springs 46*a* and 46*b* are beforehand assembled into the spring assembly 45, correction of shift in position and falling-down of the springs 46*a* and 46*b*, and holding or retaining operation of the springs can be dispensed with in the operation of incorporating the spring assembly 45 into the housing 10. This also makes it possible to improve the assembling working or operating efficiency.

Since, in the embodiment, the fuel reservoir chamber 64 is formed in the body 11, the top of the body 11 does not open largely and, therefore, holding of posture of the springs 46*a* and 46*b* and correction of the posture thereof are impossible in the operation of incorporating the spring assembly 45 into the body 11. Accordingly, it is advantageous particularly for the arrangement of the embodiment that the spring assembly 45 is beforehand assembled.

After mounting of the head assembly, mounting of accessory equipments such as the filter 68, the cover 13, the electromagnetic valves 100, 120 and 140, the delivery valves 110 and so on is carried out.

It is to be understood that the invention is not limited to the above-described specific embodiment, but various changes and modifications can be made to the invention. For instance, the outlet port for lubricating oil, formed in the housing, may be so altered that the liquid level of the lubricating oil coincides substantially with the central axes of the respective plunger and drive shaft, or is brought to a position above these central axes. By doing so, not only lubrication of the cam mechanism, but also lubrication between the plunger and the barrel and lubrication of the bearings for the drive shaft are further ensured. Moreover, the lubricating oil may be filled in the cam chamber. In this case, pressure equal to or higher than the fuel supply pressure may be applied to the lubricating oil.

As the lubricating oil, light oil that is regular fuel for a diesel engine may be used in substitution for the usual engine oil.

What is claimed is:

1. A distribution-type fuel injection pump comprising:

(a) a housing having a hollow body whose one end opens, a head fixedly mounted to said body by means of bolts so as to close the opening of said body, and a barrel section provided at said head;

(b) a drive shaft extending through and supported by a portion of said body on the opposite side from said barrel section, said drive shaft having one end thereof which projects to the outside of said body, the other end of said drive shaft being exposed to the hollow portion of said body;

(c) a plunger having one end thereof connected to the other end of said drive shaft in such a manner that rotation of said drive shaft can be transmitted to said plunger and that said plunger can axially reciprocate relatively to said drive shaft, the other end of said plunger being inserted in said barrel section and cooperating with said barrel section to define a fuel pressurizing chamber; and (d) a cam mechanism accommodated in said housing for giving axial reciprocative motion to said plunger following rotation of said plunger, said cam mechanism comprising a roller holder, a plurality of rollers rotatably supported by said roller holder, a cam disc connected to said plunger and in contact with said rollers, and a spring assembly biasing said plunger and said cam disc toward said rollers, wherein said spring assembly comprises spring means, a pair of first and second annular spring seats and an engaging member, wherein said plunger extends through said first and second spring seats, and said first and second spring seats are arranged respectively at opposite ends of said spring means, wherein said first spring seat has an annular base section and an extension extending from a peripheral edge of said base section toward said second spring seat, said engaging member being fixedly mounted to a forward end of said extension, wherein said second spring seat has a peripheral edge which is arranged within said extension of said first spring seat, wherein said engaging member projects radially inwardly from the forward end of said extension of said first spring seat, wherein said peripheral edge of said second spring seat is located at a position spaced from said engaging member toward said base section of said first spring seat, and wherein said second spring seat is urged toward said cam disc by said spring means.

2. A distribution-type fuel injection pump according to claim 1, wherein said extension of said first spring seat is tubular in shape, wherein said engaging member is in the form of a ring, and wherein said engaging member has its inner diameter which is smaller than an inner diameter of the forward end of said extension and which is smaller than an outer diameter of said second spring seat.

3. A distribution-type fuel injection pump according to claim 2, wherein said first spring seat is fixedly mounted to an inner end face of said head.

4. A method of manufacturing a distribution-type fuel injection pump, comprising the steps of:

(a) in a state in which a pair of first and second spring seats are arranged respectively at opposite ends of spring means, moving at least one of said first and second spring seats toward the other while compressing said spring means, wherein said first spring seat is provided with a base section and an extension extending from a peripheral edge of said base section toward said second spring seat, and wherein, by compression of said spring means, a peripheral edge of said second spring seat is located at a position spaced from a forward end of said extension of said first spring seat toward said base section;

(b) in a state in which said spring means is compressed, fixedly mounting an engaging member to the forward end of said extension of said first spring seat;

(c) after fixed mounting of said engaging member, releasing the compressed state of said spring means, to bring said peripheral edge of said second spring seat into engagement with said engaging member under elastic force of said spring means, thereby assembling a spring assembly;

(d) accommodating said spring assembly into a hollow body whose one end opens, wherein said second spring seat is received by a cam disc which has already been accommodated in said body before said spring assembly; and (e) fixedly mounting a head to said body to close the opening of said body, wherein bolts extending through said head are screwed into said body whereby said head is fixedly mounted to said head, wherein, at the screwing of said bolts, said bolts recieve the elastic force of said spring means for the first time when said bolts are screwed into said body by their respective predetermined amounts, wherein, after the bolts have been screwed into said body by their respective predetermined amounts, said bolts are further screwed into said body against the elastic force of said spring means, whereby said head is fixedly mounted to said body, and wherein, at the fixed mounting of said head to said body, said engaging member moves toward said cam disc relatively to said second spring seat, whereby said second spring seat is separated from said engaging member so that said second spring seat is located at a position spaced from said engaging member toward said head.

5. A method according to claim 4, including the step of, prior to assembling of said spring assembly, beforehand fixedly mounting said first spring seat to said head.

6. A distribution-type fuel injection pump comprising:

(a) a housing comprising a hollow body whose one end opens and a head fixedly mounted to said body so as to close the opening of said body, said head being provided with a barrel section, said body and said head cooperating with each other to define an internal space, said internal space having a small chamber and a large chamber which are isolated from each other, said large chamber including a cam chamber in which lubricating oil is accumulated;

(b) a drive shaft extending through an supported by a portion of said body on the opposite side from said barrel section, said drive shaft having one end thereof projecting to the outside of said housing, the other end of said drive shaft being exposed to said cam chamber;

(c) a plunger having one end thereof connected to the other end of said drive shaft in such a manner that rotation of said drive shaft can be transmitted to said plunger and that said plunger can axially reciprocate relatively to said drive shaft, the other end of said plunger being inserted in said barrel section and cooperating with the latter to define a fuel pressurizing chamber;

(d) a cam mechanism accommodated in said cam chamber for giving axial reciprocative motion to said plunger following rotation of the latter;

(e) a feed pump arranged within said small chamber in said housing and driving by said drive shaft to feed fuel;

(f) a fuel supply passageway provided in said housing, said fuel supply passageway being cut off from communication with said cam chamber and bypassing the latter such that said feed pump communicates with said fuel pressurizing chamber through said fuel supply passageway, wherein a part of said fuel supply passageway is formed in a peripheral wall portion of said housing which surrounds said cam chamber;

(g) a plurality of fuel discharge passageways provide in said head of said housing, wherein pressurized fuel within said fuel pressurizing chamber is supplied successively to said fuel discharge passageways; and (h) an annular partition plate having one end thereof contact with an inward end face of said head in an oil-tight manner and having another end in contact with an inner peripheral surface of said body in an oil-tight manner, whereby said large chamber of said internal space is divided into said cam chamber and an annular space, wherein said annular space serves as a part of said fuel supply passageway, wherein said fuel supply passageway further has a passage section formed in said head, said passage section having one end thereof communicating with said annular space, the other end of said passage section communicating with said fuel pressurizing chamber.

7. A distribution-type fuel injection pump according to claim 6, wherein said housing further comprises a cover fixedly mounted to a peripheral wall of said body, wherein said body has a recess formed in an outer surface of the peripheral wall of said body, wherein said recess and said cover cooperate with each other to define a fuel reservoir chamber for absorbing pulsation of fuel pressure, and wherein said fuel reservoir chamber communicates with each annular space through a bore formed at a bottom of said recess in said body.

8. A distribution-type fuel injection pump according to claim 7, wherein said fuel supply passageway is provided with a second passage section formed in said body, wherein said second passage section has one end thereof communicating with a discharge port of said feed pump, while the other end of said second passage section opens to the outer peripheral surface of said body, wherein said fuel supply passageway further has a third passage section formed in said cover, said third passage section having its opposite ends which open to a face of said cover which faces toward said body, said third passage section having one end thereof communicating with the other end of said second passage section in said body, the other end of said third passage section communicating with said fuel reservoir chamber.

9. A distribution-type fuel injection pump according to claim 6, wherein said cam mechanism comprises an annular roller holder, a plurality of rollers supported by said roller holder, and a cam disc connected to said one end of said plunger and in contact with said rollers, wherein a timer device for adjusting angular movement of said roller holder is mounted to said body, and wherein said timer device communicates with said annular space and utilizes pressure of fuel which is discharged from said feed pump and which flows through said annular space.

10. A distribution-type fuel injection pump according to claim 6, wherein said housing further comprises a cover fixedly mounted to peripheral wall of said body, and wherein said part of said fuel supply passageway is formed in said cover.

* * * * *

UNITED STATES PATENT AND TRADEMARK OFFICE

CERTIFICATE OF CORRECTION

PATENT NO. : 5,000,668

DATED : March 19, 1991

INVENTOR(S) : Hisashi Nakamura, Toshiro Hirakawa, Ken-ichi

It is certified that error appears in the above-indentified patent and that said Letters Patent is hereby corrected as shown below:

Column 16, line 25, claim 6, please delete "driving" and replace with --driven --.

Column 16, line 63, claim 7, please delete "each" and replace with --said --.

Signed and Sealed this

Thirteenth Day of July, 1993

*Attest:*

*Attesting Officer*

Michael K. Kirk

MICHAEL K. KIRK

*Acting Commissioner of Patents and Trademarks*